US005619762A

United States Patent [19]

Mein

[11] Patent Number: 5,619,762

[45] Date of Patent: Apr. 15, 1997

[54] APPARATUS FOR ASSISTING A PERSON IN STANDING FROM A SEATED POSITION

[76] Inventor: Jake Mein, 315 Bryan Rd., Ottumwa, Iowa 52501

[21] Appl. No.: 508,390

[22] Filed: Jul. 31, 1995

[51] Int. Cl.[6] ..... B61G 7/00

[52] U.S. Cl. ..... 5/86.1; 414/592; 414/921; 5/83.1; 254/2 R; 187/244; 280/250.1; 297/344.12; 297/344.2; 297/344.18

[58] Field of Search ..... 414/529, 921; 297/338, 339, 344.12, 344.18, 344.2; 248/404; 108/149; 280/304.1, 250.1; 187/200, 244, 267; 254/2 R; 5/83.1, 86.1, 81.1 R

[56] References Cited

U.S. PATENT DOCUMENTS

| | | | |
|---|---|---|---|
| 2,673,987 | 4/1954 | Upshaw et al. . | |
| 2,854,673 | 10/1958 | Ramsey . | |
| 2,962,730 | 12/1960 | Carner et al. | 5/86.1 |
| 3,189,345 | 6/1965 | Simpson | 280/304.1 X |
| 3,806,194 | 4/1974 | Kolebaba . | |
| 3,908,565 | 9/1975 | Burnett | 108/147 |
| 3,938,820 | 2/1976 | Nabinger . | |
| 3,940,808 | 3/1976 | Petrini | 5/83.1 |
| 3,998,284 | 12/1976 | James . | |
| 4,574,410 | 3/1986 | Lassmann et al. . | |
| 4,752,102 | 6/1988 | Rasmussen | 187/267 X |
| 4,843,661 | 7/1989 | Skibinski . | |
| 4,884,841 | 12/1989 | Holley | 297/344.2 X |
| 5,299,659 | 4/1994 | Imbeault et al. | 414/592 |

*Primary Examiner*—Karen B. Merritt
*Assistant Examiner*—Stephen Gordon
*Attorney, Agent, or Firm*—Zarley, McKee, Thomte, Voorhees, & Sease

[57] ABSTRACT

A lift for persons needing assistance in moving from a seated position to a standing position, includes an elongated seat raiseable by a jack under the seat and supported on a base assembly. The elongated seat includes stabilizer arms which extend on opposite sides of an adjacent post into engagement with a remote post for sliding engagement when the elongated seat is being raised.

6 Claims, 2 Drawing Sheets

APPARATUS FOR ASSISTING A PERSON IN STANDING FROM A SEATED POSITION

BACKGROUND OF THE INVENTION

Standing from a seated position on a chair or sofa may be a problem because of the age of the person or the person having arthritis, as examples. The person, once standing, is capable of being independently mobile.

There are numerous institutional devices available that have as their purpose lifting a person laying down on a bed and transporting that person to another location. The person is ordinarily unable to move about on his or her own. Representative of these devices is an invalid carrier with rotatable chair, U.S. Pat. No. 2,673,987. This carrier device, however, is unsuited for purposes of this invention in that it was not intended for, nor is it capable of, being positioned on a furniture seat between the sitting person and the furniture arm, such that the person can slide onto the seat and be raised to a standing position. The device in the '987 patent takes a person from a horizontal position to a seated position and is then used to transport the person in a seated position.

SUMMARY OF THE INVENTION

A lift is provided that has an elongated seat with an outer free end which is adapted to be positioned on a furniture seat between the seated person and the furniture arm, such that the person can slide onto the elongated seat and through operation of a jack control, raise him or herself to a standing position. This lift is not intended for persons laying on a bed or for transporting these persons once they have been lifted from a seated position to a standing position.

The lift structure includes a base assembly having in alignment a pair of spaced apart vertical posts and a jack on which the elongated seat is mounted. The elongated seat includes a pair of stabilizer arm members which extend on opposite sides of one of the posts to engagement with a sleeve on the post most remote to the jack. An arm rest support interconnects the upper ends of the spaced apart posts. The outer end of the elongated seat extends outwardly beyond base assembly arms having wheels on their outer ends.

DESCRIPTION OF THE PREFERRED EMBODIMENT

Figures 1, 2:
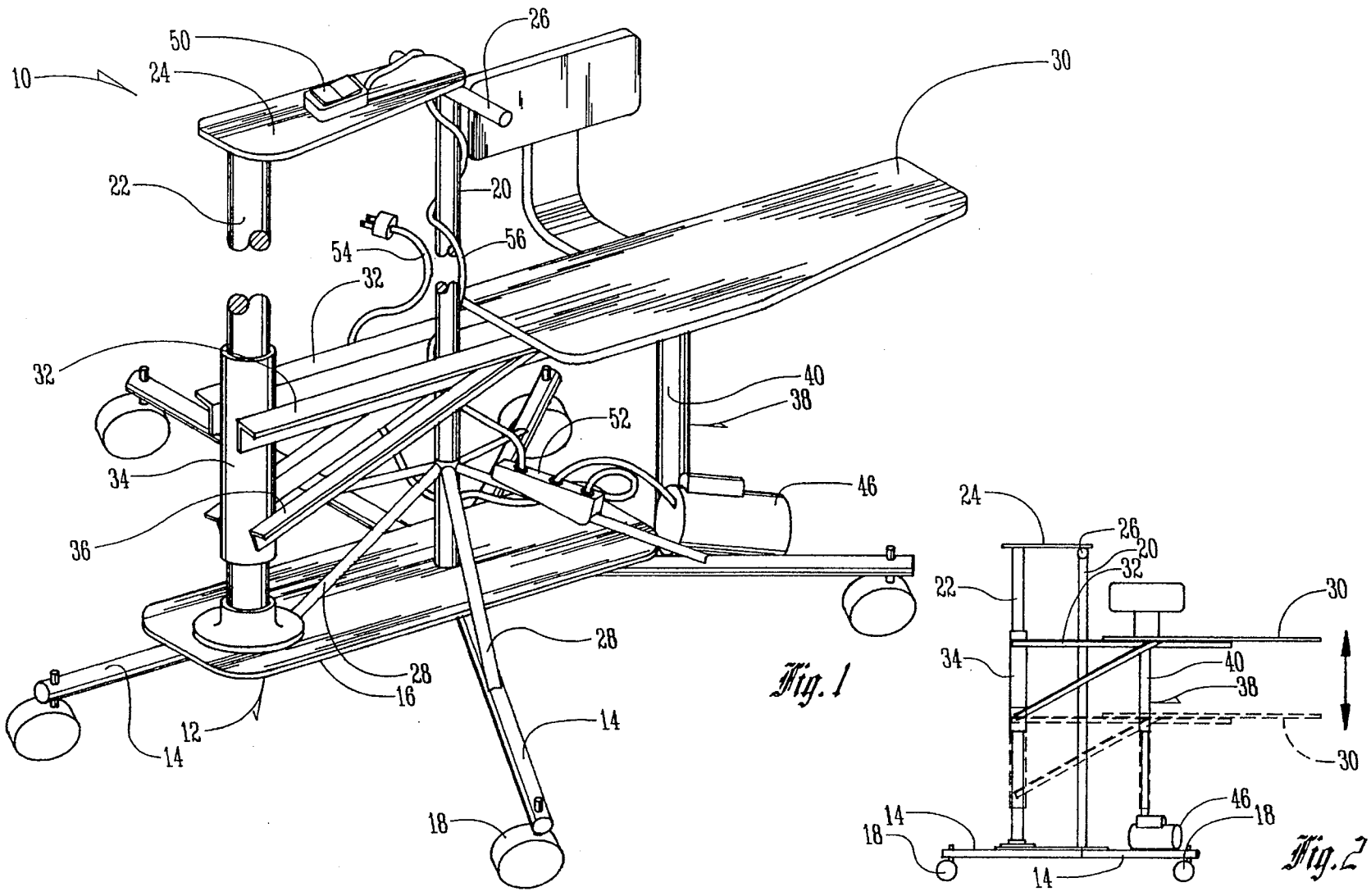
FIG. 1 is a perspective view of the lift device of this invention.
FIG. 2 is a reduced in scale side elevation view thereof.
Figure 3:
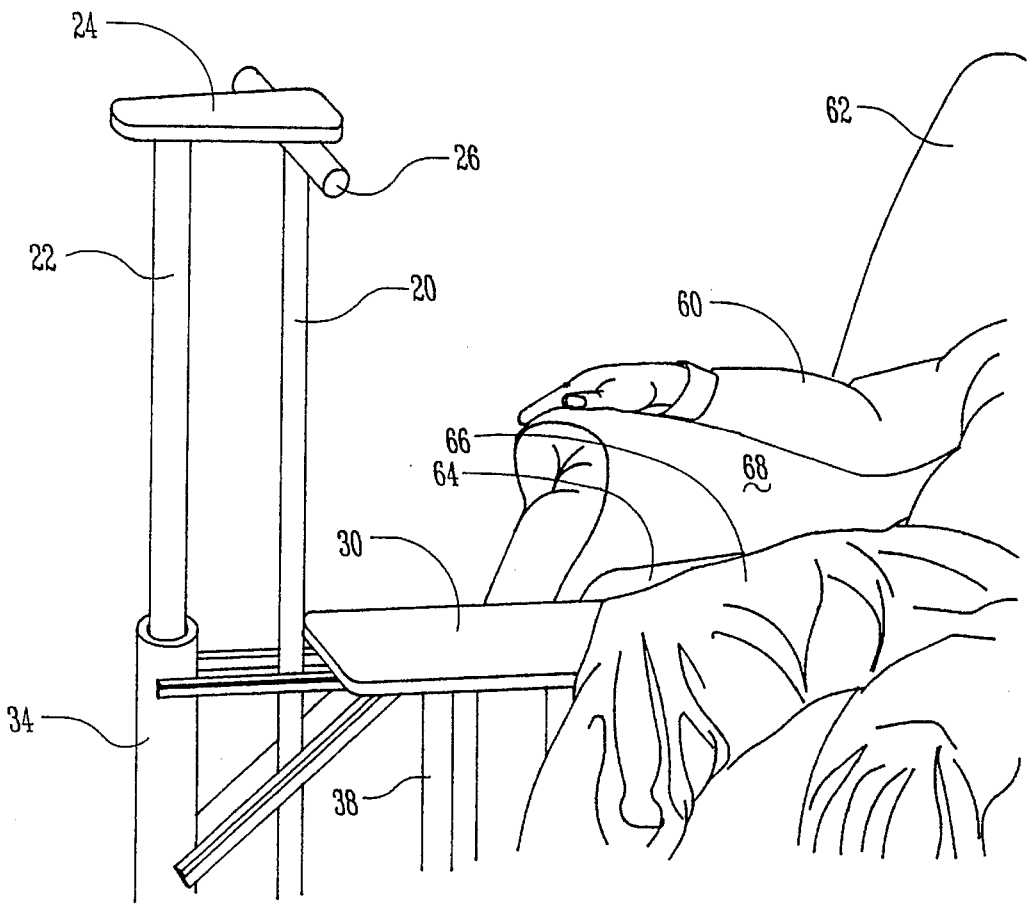
FIG. 3 is a fragmentary perspective view showing the elongated seat of the lift device positioned on a furniture seat between a person and the furniture arm rest.
Figure 4:
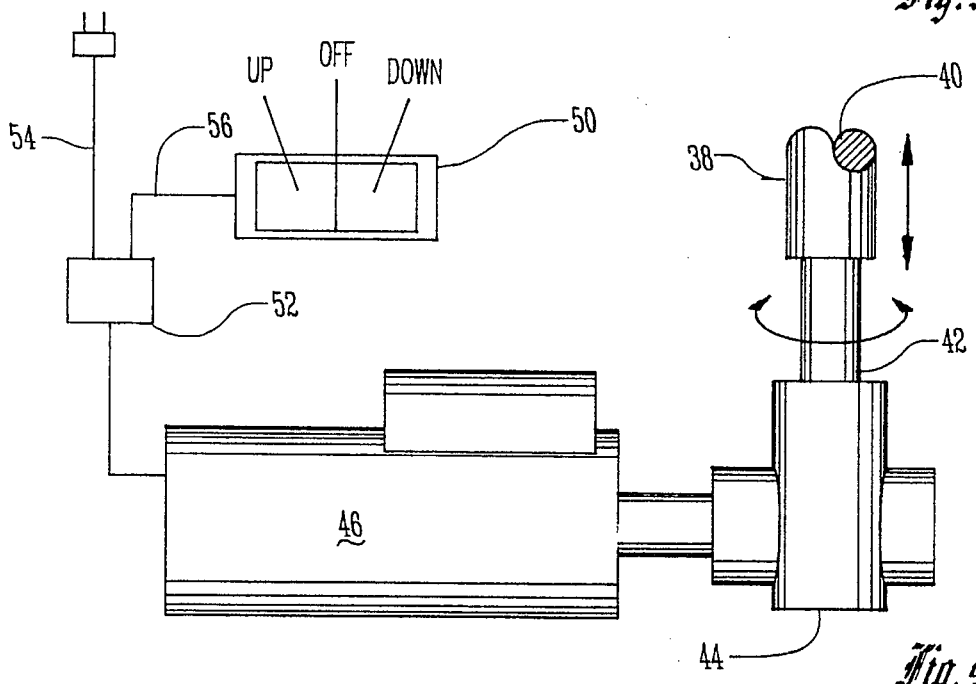
FIG. 4 is a fragmentary schematic view of the control circuit for operating the motor, direct drive transmission and jack.

The lift device of this invention is referred to generally in FIG. 1 by the reference numeral 10 and includes a base assembly 12. The base assembly 12 comprises a plurality of legs 14 interconnected at their inner ends by a plate 16 and having caster wheels 18 at their outer ends.

A pair of spaced apart aligned posts 20 and 22 are mounted on the plate 16 and are interconnected at their upper ends by an arm rest 24, which includes a transversely extending handle 26 at the junction of the arm rest with the post 20. A plurality of braces 28 extend from the legs 14 and the plate 16 to engagement with the post 20.

An elongated seat 30 includes a pair of stabilizer angle iron support arms 32 which extend on opposite sides of post 20 into engagement with a sleeve 34 slideably moveable on the post 22. Angle iron braces 36 extend from the lower end of the sleeve 34 outwardly and upwardly into engagement with the stabilizer arms 32 under the elongated seat 30.

A screw jack 38 directly supports the elongated seat 30 and includes a tube 40 into which a threaded shaft 42 extends from a direct drive transmission 44 on the base assembly 12 and connected to a motor 46.

The control circuitry for operating the motor 46 and, thus, the screw jack 38 includes a switch 50, movable between up and down and off positions connected through a junction box 52 to the motor 46. A power cord 54 is also connected to the junction box 52. It is understood that the motor 46 could be powered by batteries if desired. The switch 50 is connected to the control box by a cord 56 and is positionable as is appropriate for access by a person 60 on a chair or sofa 62. When not in use the control switch 50 may be positioned on the arm rest 24.

In operation, the person using the lift device of this invention would position it near the furniture seat 64 such that when it was desired to stand it would be available for use. The seated person 60 can grasp the elongated seat 30 and position it over the furniture seat 64 between the persons legs 66 and the furniture arm 68. The person 60 would then slide laterally onto the elongated seat 30. The person 60 would then operate the control switch 50 by moving it to the "up" position, causing the screw jack 38 to be operated, thereby raising the elongated seat 30 from the position in "dash" lines in FIG. 2 to the "solid" line position. The person 60 now is able to simply walk away from the lift device 10.

The lift device 10 could be used as a walker and may also be used for lowering the person back onto the furniture seat if desired. In any event, in preparation for its next use, the elongated seat 30 would be lowered to the "dash" line position of FIG. 2.

What is claimed is:

1. A lift for assisting a person in standing from a seated position comprising, a base assembly having a plurality of outwardly extending arms with wheels at their outer ends, a pair of spaced apart vertically positioned posts on said base assembly, said pair of posts having upper ends and an arm rest support extending between and on the upper ends of said pair of posts, an upstanding jack means on said base assembly positioned in alignment with said pair of posts, one of said pair of posts being located more remotely from said jack means than the other of said pair of posts, said jack means having an upper end, an elongated seat on the upper end of said jack means and said elongated seat having a stabilizer arm means extending into sliding engagement with the post of said pair of posts most remote to said jack means, said elongated seat having an outer free end adapted to be positioned on a furniture seat between the furniture arm and a person for the person to slide onto and be raised to a standing position by operation of the jack means.

2. The lift of claim 1 wherein said stabilizer arm means includes a sleeve in which said most remote post is received for relative slideable movement there between.

3. The lift of claim 2 wherein said stabilizer arm means includes a pair of spaced apart arm members having inner ends which extend on opposite sides of the most remote post and are connected at their inner ends to said sleeve.

4. The lift of claim 1 wherein said outer free end of said elongated seat is positioned horizontally outwardly of and above adjacent ones of said assembly arms and wheels.

5. The lift of claim 1 wherein a control means is provided for operating said jack means, said control means is on a cord operatively connected to said jack means for being positioned for operation by a person seated on said elongated seat.

6. The lift of claim 1 wherein said jack means includes a screw mechanism and said jack is positioned directly under said elongated seat.

* * * * *